US006671961B1

(12) United States Patent
Santhagens Van Eibergen et al.

(10) Patent No.: US 6,671,961 B1
(45) Date of Patent: Jan. 6, 2004

(54) SHAVER PROVIDED WITH A SHAVING HEAD HAVING A SUB-FRAME AND A MAIN FRAME

(75) Inventors: Robert Alexander Santhagens Van Eibergen, Drachten (NL); Johan Pragt, Drachten (NL); Jasper Zuidervaart, Drachten (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 237 days.

(21) Appl. No.: 09/723,425

(22) Filed: Nov. 28, 2000

(30) Foreign Application Priority Data

Nov. 29, 1999 (EP) ..... 99204020

(51) Int. Cl.[7] ..... B26B 21/22
(52) U.S. Cl. ..... 30/50; 30/34.2
(58) Field of Search ..... 30/50, 34.2, 47

(56) References Cited

U.S. PATENT DOCUMENTS

| | | | | | |
|---|---|---|---|---|---|
| 4,868,983 | A | * | 9/1989 | Francis | 30/50 |
| 4,932,123 | A | * | 6/1990 | Francis | 30/50 X |
| 5,152,064 | A | * | 10/1992 | Johnston | 30/50 X |
| 5,222,300 | A | * | 6/1993 | Althaus et al. | 30/50 |
| 5,224,267 | A | * | 7/1993 | Simms et al. | 30/50 |
| 5,251,376 | A | * | 10/1993 | Althaus et al. | 30/50 |
| 5,301,425 | A | * | 4/1994 | Ferraro | 30/50 X |
| 5,369,885 | A | * | 12/1994 | Ferraro | 30/50 X |
| 5,416,974 | A | * | 5/1995 | Wain | 30/50 |
| 5,546,660 | A | * | 8/1996 | Burout et al. | 30/50 |
| 5,953,825 | A | * | 9/1999 | Christman et al. | 30/50 X |
| 5,964,034 | A | * | 10/1999 | Sueyoshi et al. | 30/34.2 |
| 6,055,731 | A | * | 5/2000 | Zucker | 30/34.2 X |
| 6,141,875 | A | * | 11/2000 | Andrews | 30/50 |
| 6,145,201 | A | * | 11/2000 | Andrews | 30/50 |
| 6,161,287 | A | * | 12/2000 | Swanson et al. | 30/50 |
| 6,161,288 | A | * | 12/2000 | Andrews | 30/50 |
| 6,185,823 | B1 | * | 2/2001 | Brown et al. | 30/50 |
| 6,295,734 | B1 | * | 10/2001 | Gilder et al. | 30/50 |
| 6,378,211 | B1 | * | 4/2002 | McCool et al. | 30/50 |
| 6,397,473 | B1 | * | 6/2002 | Clark | 30/50 |

FOREIGN PATENT DOCUMENTS

| | | | | |
|---|---|---|---|---|
| EP | 0429174 A2 | * | 5/1991 | 30/50 |
| JP | 4-117987 | * | 4/1992 | 30/50 |
| JP | 5-192 | * | 1/1993 | 30/50 |
| WO | WO 95/04637 | * | 2/1995 | 30/50 |
| WO | WO9726119 | | 7/1997 | |

* cited by examiner

*Primary Examiner*—Charles Goodman
(74) *Attorney, Agent, or Firm*—Ernestine C. Bartlett

(57) ABSTRACT

A shaving device which comprises a shaving head (1) having at least one cutting blade (5) and two skin-supporting members (11, 13), said skin-supporting members, viewed in the shaving direction, being arranged, respectively, in front of and behind said cutting blade, and defining a contact surface (17) between the shaving head and a skin surface (53) to be treated. The cutting blade and the skin-supporting members are mounted to a sub-frame (9), which is coupled to a main frame (19) and can be displaced with respect to said main frame against a spring force ($F_s$). The main frame comprises two further skin-supporting members (21, 23) which, viewed in the shaving direction, are arranged, respectively, in front of and behind the sub-frame and extend substantially in said contact surface. As a result, a contact force ($F_c$) between the skin surface and the skin-supporting members of the sub-frame and hence a skin curvature ($\omega_2$) between the skin-supporting members of the sub-frame, i.e. at the location of the cutting member, is mainly determined by the value of said spring force and, accordingly, substantially independent of a pressure force ($F_p$) exerted by a user to press the shaving head against the skin surface.

5 Claims, 5 Drawing Sheets

SHAVER PROVIDED WITH A SHAVING HEAD HAVING A SUB-FRAME AND A MAIN FRAME

BACKGROUND OF THE INVENTION

The invention relates to a shaver comprising a shaving head including at least one cutting blade and two skin-supporting members, the cutting blade having a cutting edge extending perpendicularly to a shaving direction of the shaving head, and the skin-supporting members being arranged, viewed in the shaving direction, respectively, in front of and behind the cutting blade and extending substantially in a contact surface wherein, in operation, the shaving head contacts a skin surface to be treated, while the cutting blade and the skin-supporting members are secured to a sub-frame, which is coupled to a main frame and can be displaced, against a spring force, with respect to the main frame.

The invention also relates to a shaving head which can suitably be used in a shaver in accordance with the invention.

A shaver of the type mentioned in the opening paragraph is disclosed in WO-A-97/26119. The shaving head of the known shaver comprises two mutually parallel cutting blades which, viewed in the shaving direction, are arranged between the two skin-supporting members. If the user places the shaving head on the skin surface, an exerted press-on force is transmitted to the skin surface mainly via the two skin-supporting members. As a result, a contact force exerted by the cutting blades on the skin surface is limited, and lesions to the skin surface, which could occur during moving the shaving head in the shaving direction over the skin surface as a result of too large a contact force between the cutting blades and the skin surface, are precluded as much as possible. In the known shaver, the main frame of the shaving head is attached to a handle, while the sub-frame of the shaving head is attached to the main frame by means of four mechanical torsion springs. As a result, when the shaving head is moved over the skin surface, the sub-frame follows the contours present in the skin surface as accurately as possible, so that the cutting blades continually contact the skin surface as completely as possible.

A drawback of the known shaver resides in that a skin curvature, which is present at the location of the cutting blades and which develops under the influence of the press-on force, depends upon a size of said press-on force. If the press-on force is comparatively small, the skin curvature is comparatively small too, so that only a comparatively limited smoothness of the skin surface is attained. If the press-on force is relatively large, the skin curvature is comparatively large too, which results in a very smooth skin surface, but which may also lead to skin irritations as a result of a comparatively large contact force between the cutting blades and the skin surface. Consequently, a shaving result obtained by means of the known shaver is highly personal and depends, in particular, on the press-on force exerted by the user when he places the shaving head on the skin surface.

SUMMARY OF THE INVENTION

It is an object of the invention to provide a shaver of the type mentioned in the opening paragraph, by means of which an achieved shaving result is much less personal, in particular, much less dependent on the press-on force exerted by a user when placing the shaving head on the skin surface.

To achieve this object, a shaver in accordance with the invention is characterized in that the main frame comprises two further skin-supporting members which, viewed in the shaving direction, are arranged, respectively, in front of and behind the sub-frame and which extend substantially in the contact surface. If a user places the shaving head of the shaver in accordance with the invention on the skin surface, an exerted press-on force is transmitted to the skin surface mainly via the two further skin-supporting members of the main frame. As a skin curvature develops between the two further skin-supporting members as a result of the press-on force, the skin surface between the two further skin-supporting members is also supported by the two skin-supporting members of the sub-frame, said sub-frame being moved against the spring force, under the influence of the skin curvature, with respect to the main frame to an equilibrium position wherein the spring force is substantially in balance with a contact force exerted by the skin surface on the sub-frame. As the size of the skin curvature depends upon the size of the press-on force, said equilibrium position also depends upon the size of the press-on force. The shaving head preferably comprises means for exerting the spring force, wherein said spring force depends as little as possible, at customary values of the skin curvature, on the position of the sub-frame with respect to the main frame. As a result, it is achieved that a supporting force, by means of which the skin surface is supported in the equilibrium position by the skin-supporting members of the sub-frame and which is determined by the size of the spring force, depends as little as possible on the skin curvature between the two further skin-supporting members and hence also depends as little as possible on the exerted press-on force. As a skin curvature present between the two skin-supporting members of the sub-frame, i.e. at the location of the cutting blade, is determined by said supporting force of the skin-supporting members of the sub-frame, this skin curvature present at the location of the cutting blade also depends as little as possible on the exerted press-on force, so that also the shaving result achieved depends as little as possible on the exerted press-on force.

A particular embodiment of a shaver in accordance with the invention is characterized in that the spring force is directed towards the contact surface, and, in a state wherein the shaving head does not contact the skin surface, the sub-frame rests against a stop of the main frame under the influence of the spring force. By using said stop, it is achieved in a constructionally simple way that, in said state, the spring force has a predetermined, desired value which is determined by a desired skin curvature between the two skin-supporting members of the sub-frame.

A further embodiment of a shaver in accordance with the invention is characterized in that the sub-frame is secured to the main frame by means of a mechanical spring unit, and is at least tiltable with respect to the main frame about two mutually perpendicular tilt axes and displaceable with respect to the main frame in a displacement direction perpendicular to said tilt axes, thereby deforming the spring unit. As a result, when the shaving head is moved over the skin surface, the sub-frame follows, to a large extent, the contours present in the skin surface, so that the cutting blade stays in full contact, or substantially full contact, with the skin surface, resulting in an effective shaving process.

Yet another embodiment of a shaver in accordance with the invention is characterized in that the spring unit comprises a central portion and two pairs of leaf springs facing away from each other, which leaf springs each extend from the central portion in a direction substantially perpendicular to the shaving direction, and each support the sub-frame at a location close to a corner. As a result, the construction of the spring unit is simple, the central portion and the two pairs of leaf springs being producible as a single part from, for example, a metal sheet. By applying the two pairs of leaf springs, it becomes possible to tilt the sub-frame, with respect to the main frame, about two mutually perpendicular tilt axes, which extend in an imaginary plane which extends approximately parallel to the contact surface, and to displace said sub-frame in a displacement direction approximately perpendicular to the contact surface.

A particular embodiment of a shaver in accordance with the invention is characterized in that the central portion of the spring unit is provided with a sphere segment-shaped supporting element with which the spring unit rests against the main frame. By using the sphere segment-shaped supporting element, the tiltability of the sub-frame, with respect to the main frame, about the two mutually perpendicular tilt axes is improved.

A further embodiment of a shaver in accordance with the invention is characterized in that the shaving head is provided with means for adjusting the spring force. Since the spring force can be adjusted by means of said means, the contact force exerted by the skin surface on the sub-frame as well as a skin curvature present between the skin-supporting members of the sub-frame are adjustable. This enables a user of the shaver to set the spring force at a desired or personally optimum level.

Yet another embodiment of a shaver in accordance with the invention is characterized in that a skin-stretching member is provided on the main frame and/or on the sub-frame, which skin-stretching member is arranged, viewed in the shaving direction, in front of the cutting blade. By using said skin-stretching member, the skin curvature between the two skin-supporting members of the sub-frame and/or between the two further skin-supporting members of the main frame is limited, so that skin irritations and incised wounds, which could occur in the case of too large a skin curvature by contact between the skin surface and the cutting blade, are precluded as much as possible. In addition, the skin-stretching member can also be used as a skin-supporting member, resulting in a reduction of the number of parts of the shaver.

A particular embodiment of a shaver in accordance with the invention is characterized in that a skin-contacting member is provided on the main frame and/or on the sub-frame, which skin-contacting member contains a shaving aid. By using the skin-contacting member, the shaving comfort is increased. The shaving aid comprises, for example, a skin lubricant which reduces a frictional force between the shaving head and the skin surface. The shaving aid may be permanently present in the skin-contacting member or it may be secreted when the skin-contacting member contacts the skin surface. The skin-contacting member may additionally serve as a skin-supporting member, resulting in a reduction of the number of parts used in the shaver.

These and other aspects of the invention will be apparent from and elucidated with reference to the embodiment(s) described hereinafter.

DETAILED DESCRIPTION OF THE PREFERRED EMBODIMENTS

Figure 1:
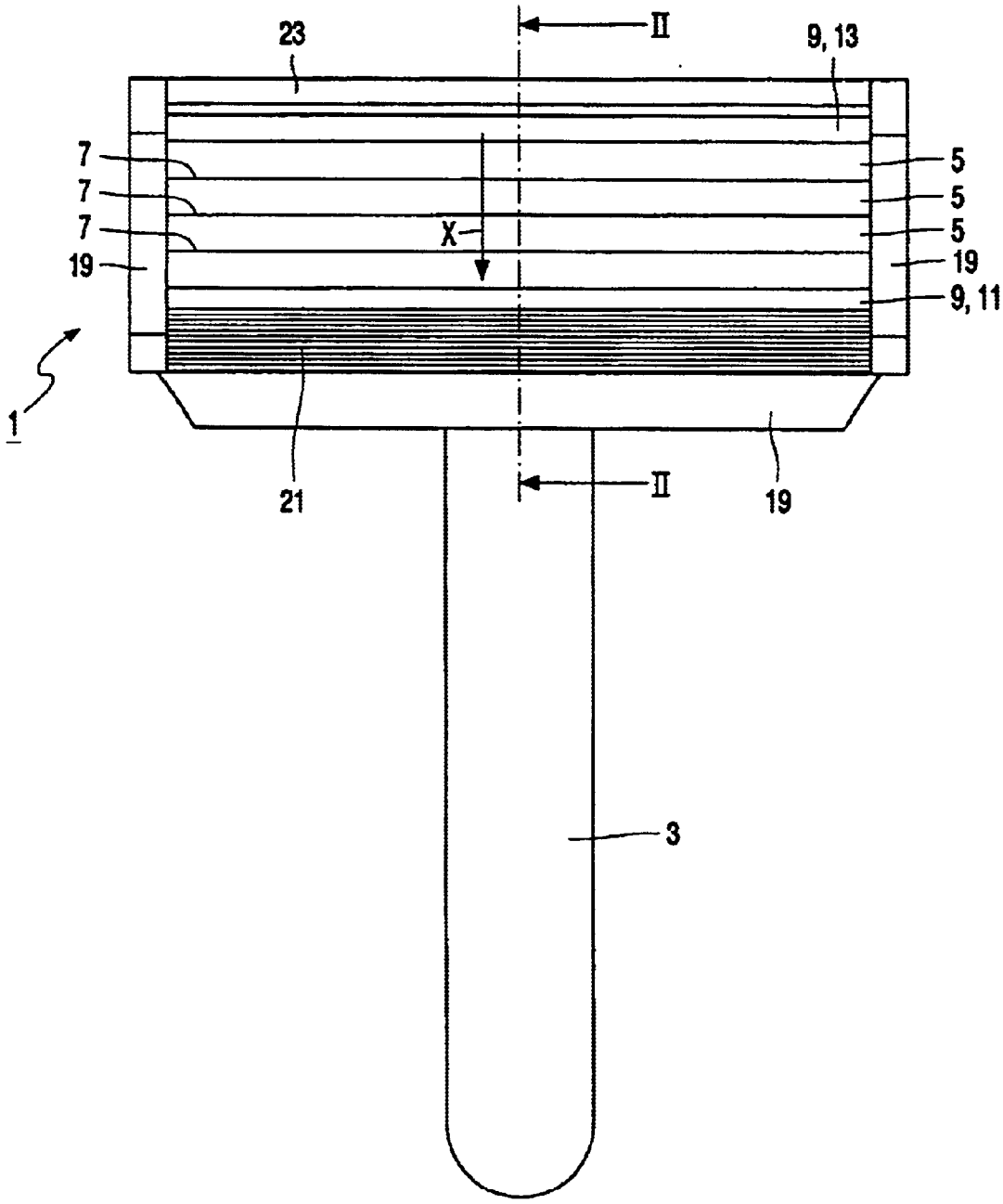
FIG. 1 diagrammatically shows an embodiment of a shaver in accordance with the invention.
Figure 2:
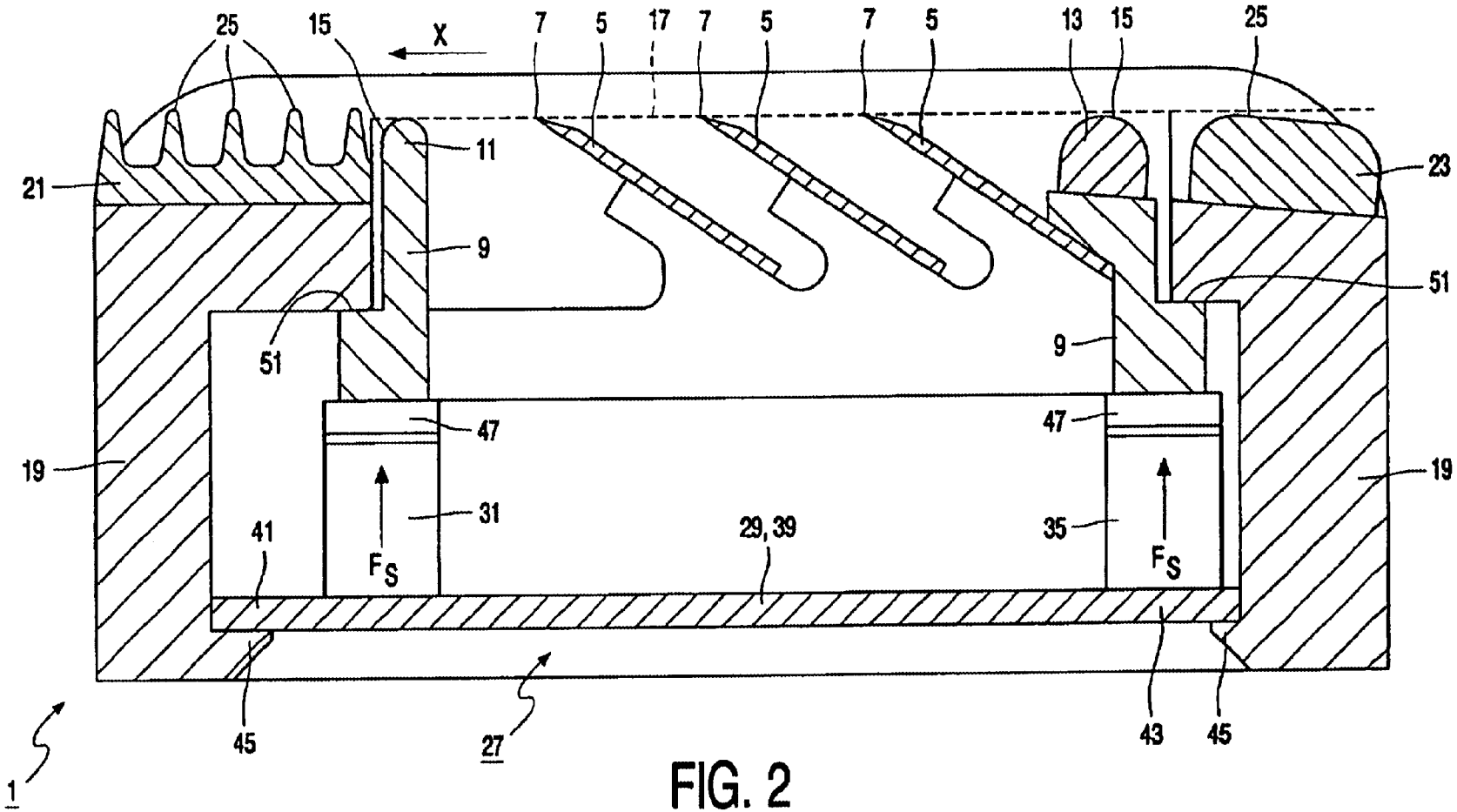
FIG. 2 is a diagrammatic, cross-sectional view of a shaving head of the shaver, taken on the line II—II in FIG. 1.

The embodiment of a shaver in accordance with the invention as shown in FIG. 1 is a wet shaver, which comprises a shaving head 1 which is detachably coupled to a handle 3 by means of a coupling mechanism which is not shown in the Figure. The shaving head 1 accommodates three mutually parallel cutting blades 5, which are each provided with a cutting edge 7 extending perpendicularly to a shaving direction X of the shaving head. As shown in FIGS. 1 and 2, the cutting blades 5 are secured to a sub-frame 9 of the shaving head 1. Two skin-supporting members 11 and 13 are also secured to the sub-frame 9, which skin-supporting members also extend perpendicularly to the shaving direction X and, viewed in the shaving direction X, are arranged, respectively, in front of and behind the cutting blades 5. The skin-supporting members 11 and 13 each comprise a skin-supporting surface 15 which extends substantially in an imaginary contact surface 17 wherein the shaving head 1 contacts, in operation, a skin surface to be treated. The shaving head 1 further includes a main frame 19, which at least partly surrounds the sub-frame 9 and on which said coupling mechanism is provided. On the main frame 19, two further skin-supporting members 21 and 23 are provided, which also extend perpendicularly to the shaving direction X and, viewed in the shaving direction X, are arranged, respectively, in front of and behind the sub-frame 9. The further skin-supporting members 21 and 23 each comprise a skin-supporting surface 25, which also extends substantially in said contact surface 17.

Figure 3:
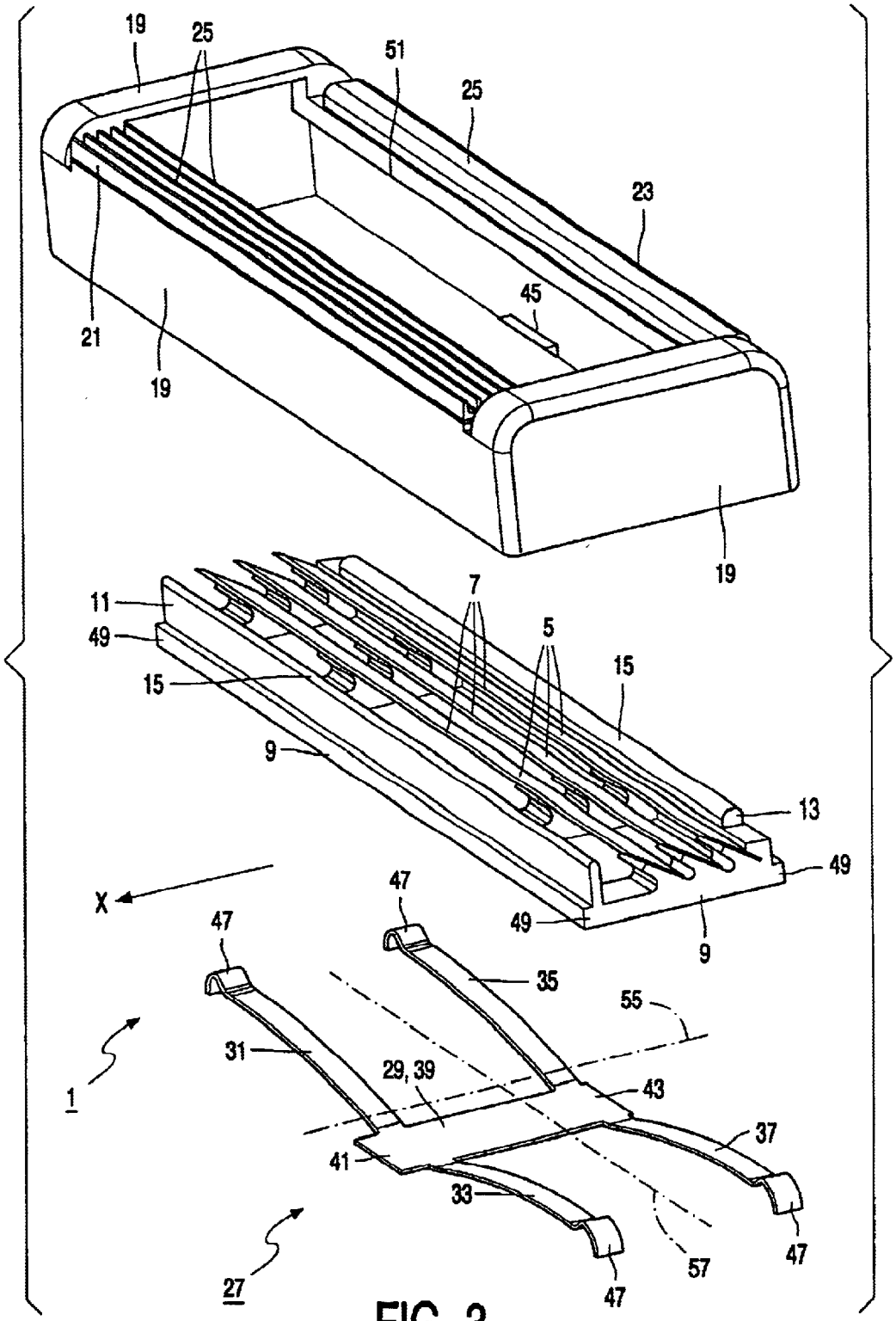
FIG. 3 shows a number of parts of the shaving head in accordance with FIG. 2.

As shown in FIG. 2, the sub-frame 9 is coupled to the main frame 19 by means of a mechanical spring unit 27. The main frame 19, the sub-frame 9 and the spring unit 27 are shown as individual parts of the shaving head in FIG. 3. As shown in FIG. 3, the spring unit 27 comprises a central portion 29 and two pairs of leaf springs 31, 33 and 35, 37. The central portion 29 comprises a strip 39 which extends substantially parallel to the shaving direction X, the leaf springs 31, 33 extending in opposite directions from a first end 41 of the strip 39 substantially perpendicularly to the shaving direction X, and the leaf springs 35, 37 extending in opposite directions from a second end 43 of the strip 39 substantially perpendicularly to the shaving direction X. The spring unit 27 thus is of a simple construction and can be manufactured as a single, integral part from a metal sheet. The two end portions 41, 43 of the strip 39 are attached to two fixing cams 45 arranged in the main frame 19. The two fixing cams 45 are shown in section in FIG. 2, while only one of the two fixing cams 45 is shown in FIG. 3. The leaf springs 31, 33, 35, 37 each have an end portion 47, which supports the sub-frame 9 near, respectively, one of the four corners 49. As shown in FIG. 2, in a state wherein the shaving head 1 does not contact a skin surface to be treated, the sub-frame 9 rests against a stop 51 of the main frame 19 under the influence of an elastic pretension $F_s$ exerted by the leaf springs 31, 33, 35, 37 of the spring unit 27, said pretension $F_s$ being directed, viewed from the central portion 29 of the spring unit 27, towards the contact surface 17.

Figure 4:
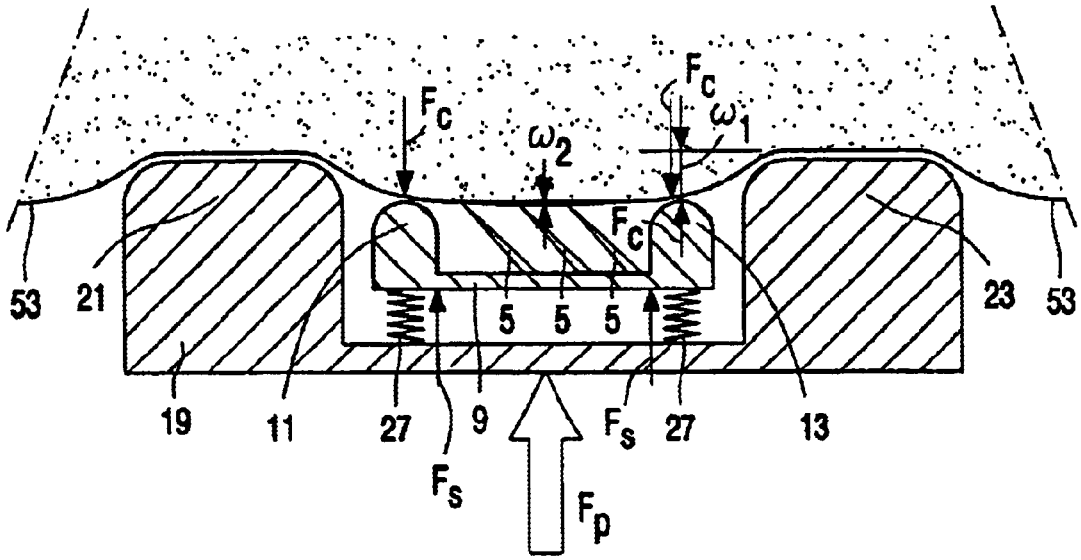
FIG. 4 shows the shaving head in accordance with FIG. 2 in a situation where the shaving head is in contact with a skin surface.

If a user places the shaving head 1 of the shaver in accordance with the invention on a skin surface to be treated, the user exerts a press-on force via the handle 3 on the shaving head 1, the size of said press-on force being highly personal. As a result of the above-described construction of the shaving head 1, the shaving result and the shaving comfort obtained by using the shaver in accordance with the invention are independent of, or only slightly dependent on, the size of the press-on force. As the main frame 19 is provided with the further skin-supporting members 21 and 23, the exerted press-on force $F_p$, as diagrammatically shown in FIG. 4, is largely transmitted to the skin surface 53 via the further skin-supporting members 21 and 23, resulting in a skin curvature $\omega_1$ between the further skin-supporting members 21 and 23, the size of which depends on the size of the press-on force $F_p$. As a result of the skin curvature $\omega_1$, the skin surface 53 between the further skin-supporting members 21 and 23 of the main frame 19 also rests against the skin-supporting members 11 and 13 of the sub-frame 9 with a contact force $F_c$, which is small as compared to the press-on force $F_p$, a skin curvature $\omega_2$ being formed, as a result of the contact force $F_c$, between the skin-supporting members 11 and 13, i.e. at the location of the cutting blades 5. As the sub-frame 9 is secured to the main frame 19 by means of the spring unit 27, the sub-frame 9 is displaced with respect to the main frame 19 under the influence of the contact force $F_c$ against the pretension $F_s$ of the spring unit 27. As a result, the skin surface 53 slackens and the contact force $F_c$ decreases to a value which is approximately equal to the pretension $F_s$, so that the sub-frame 9 takes up an equilibrium position with respect to the main frame 19. The leaf springs 31, 33, 35, 37 are preferably dimensioned and pre-compressed such that, at customary values of the press-on force $F_p$, the sub-frame 9 is displaced only over limited distances with respect to the main frame 19, so that, as a result of such displacements, the pretension $F_s$ does not change or changes only to a limited degree. It is thus achieved that, at customary values of the press-on force $F_p$ resulting from the displacement of the sub-frame 9 with respect to the main frame 19, the contact force $F_c$ assumes a value which is approximately equal to a predetermined substantially constant value of the pretension $F_s$, so that the contact force $F_c$ in the equilibrium position of the sub-frame 9 is substantially independent of the press-on force $F_p$. Since the skin curvature $\omega_2$ between the skin-supporting members 11 and 13 of the sub-frame 9 is determined by the contact force $F_c$, also the skin curvature $\omega_2$ is substantially independent, in the equilibrium position of the sub-frame 9, of the press-on force $F_p$. As the shaving result and the shaving comfort are substantially determined by the skin curvature $\omega_2$ at the location of the cutting blades 5, both the shaving result and the skin comfort are not dependent either, or only to a small extent, on the press-on force $F_p$.

As shown in FIGS. 2 and 3, the further skin-supporting member 21 of the main frame 19, which, viewed in the shaving direction X, is arranged in front of the cutting blades 5 is embodied so as to be a skin-smoothing member, which is manufactured of a material, such as a type of rubber, which has a comparatively high coefficient of friction in contact with the skin surface. Such a skin-smoothing member is customarily used in wet shavers and limits the skin curvature present between the further skin-supporting members 21 and 23 when the shaving head 1 is being displaced over the skin surface. As a result, a skin curvature which is as constant as possible is attained between the further skin-supporting members 21 and 23, so that the shaver operates in a reliable and safe manner and skin irritations and incised wounds are precluded. Since the further skin-supporting member 21 also serves as a skin-smoothing member, a simplification of the construction of the shaver is obtained. It is to be noted that, instead of the further skin-supporting member 21, the main frame 19 may be provided with a separate skin-supporting member and a separate skin-smoothing member which, viewed in the shaving direction X, are arranged in front of the sub-frame 9. In addition, also the sub-frame 9 adjoining the skin-supporting member 13 may be provided with a separate skin-smoothing member, which, viewed in the shaving direction X, is arranged in front of the cutting blades 5, or with a skin-supporting member which also serves as a skin-smoothing member. The invention further comprises embodiments wherein only the sub-frame 9 comprises a skin-smoothing member which, viewed in the shaving direction X, is arranged in front of the cutting blades 5.

FIGS. 2 and 3 also show that the further skin-supporting member 23 of the main frame 19 is embodied so as to be a skin-contacting member containing a shaving aid, such as a skin lubricant, which reduces the friction force between the shaving head 1 and the skin surface, or a skin lotion. Such a skin-contacting member containing a shaving aid is customarily used in wet shavers and increases the shaving comfort. As the further skin-supporting member 23 also serves as a skin-contacting member, a simplification of the construction of the shaver is obtained. It is to be noted that, instead of the further skin-supporting member 23, the main frame 19 may be provided with a separate skin-supporting member and a separate skin-contacting member. In addition, also the sub-frame 9 adjoining the skin-supporting member 13 may be provided with a separate skin-contacting member, or with a skin-supporting member which also serves as a skin-contacting member. The invention also comprises embodiments wherein only the sub-frame 9 comprises a skin-contacting member.

By using the spring unit 27, the sub-frame 9 cannot only be displaced with respect to the main frame 19 in a direction substantially perpendicular to the contact surface 17, as described hereinabove, but be tilted as well with respect to the main frame 19 about two mutually perpendicular tilt axes 55 and 57, shown in FIG. 3, which are directed substantially parallel to the contact surface 17. Tilting about the tilt axis 55, which extends substantially parallel to the shaving direction X, is possible, thereby causing the leaf springs 31, 35 and 33, 37 to bend in opposite directions. Tilting movements about the tilt axis 57, which extend substantially parallel to the cutting edges 7, are possible, thereby causing bending of the leaf springs 31 and 33 in a direction opposite to the leaf springs 35 and 37. In this manner, it is achieved that, upon displacing the shaving head 1 over the skin surface, the sub-frame 9 with the cutting blades 5 follows the contours present in the skin surface to the best of its abilities. Thereby ensuring that the largest possible part of the cutting blades 5 is continually in contact with the skin surface, resulting in a most effective shaving process.

Figure 5:
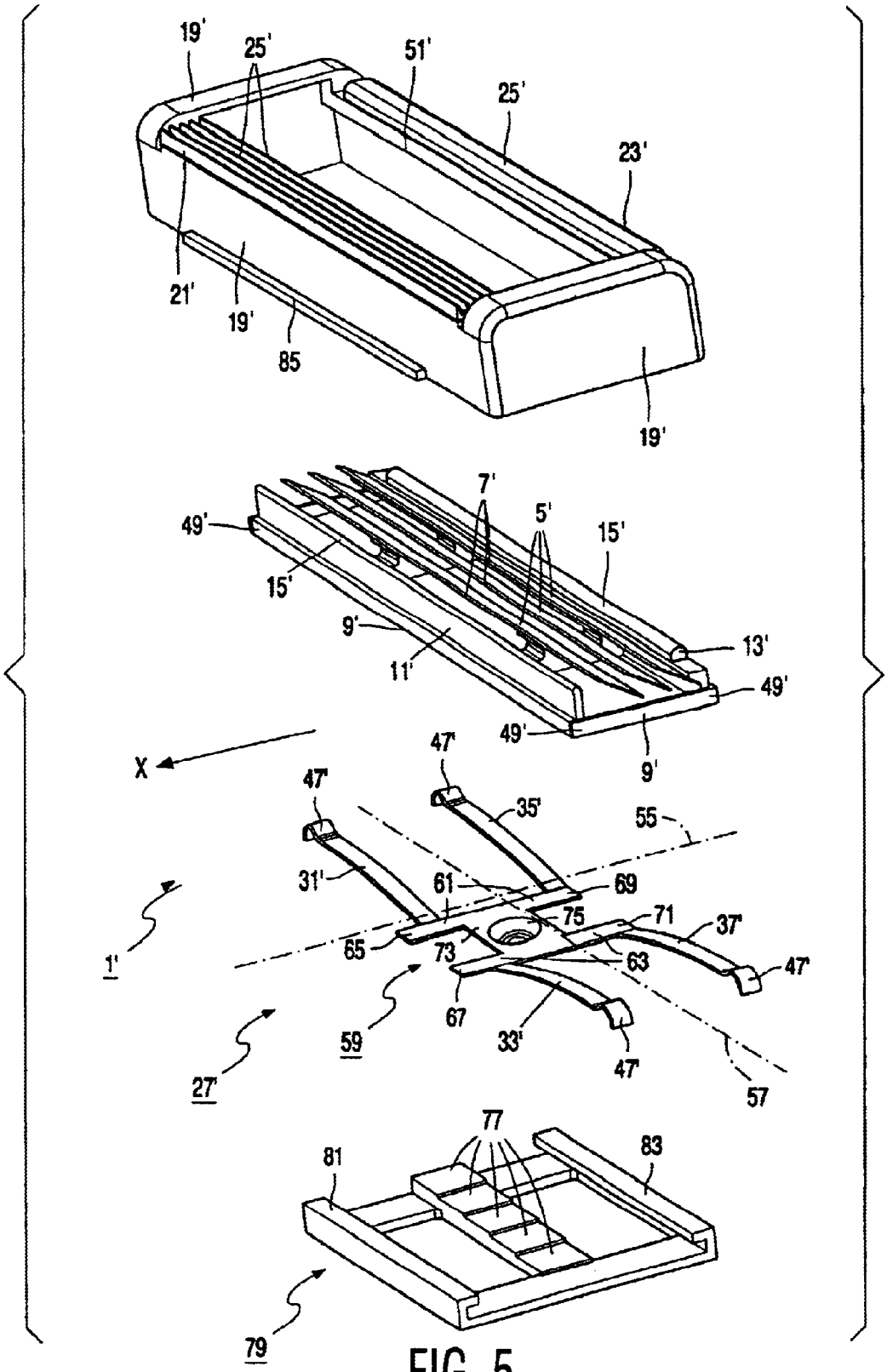
FIG. 5 shows a number of parts of a shaving head of an alternative embodiment of a shaver in accordance with the invention.

The predetermined, substantially constant value of the pretension $F_s$ of the above-described shaver in accordance with the invention forms a design parameter which, for example, is determined such that, for an average type of skin surface, a desired skin curvature $\omega_2$ between the two skin-supporting members 11 and 13 of the sub-frame 9 is obtained. FIG. 5 shows a number of parts of a shaving head 1' of an alternative embodiment of a shaver in accordance with the invention, which is provided with means enabling said pretension to be adjusted by the user. In FIG. 5, parts of the shaving head 1' which correspond to parts of the shaving head 1 shown in FIG. 3 are indicated by means of corresponding reference numerals. Hereinbelow, only a number of differences between the shaving head 1' and the shaving head 1 are discussed. The shaving head 1' comprises a spring unit 27' having a central portion 59 and two pairs of leaf springs 31', 33' and 35', 37'. The central portion 59 comprises two strips 61 and 63 which extend substantially parallel to the shaving direction X; the leaf springs 31' and 33' extend in opposite directions from, respectively, a first end 65 of the strip 61 and a first end 67 of the strip 63 in a direction substantially perpendicular to the shaving direction X, while the leaf springs 35' and 37' extend in opposite directions from, respectively, a second end 69 of the strip 61 and a second end 71 of the strip 63 in a direction substantially perpendicular to the shaving direction X. The strips 61 and 63 are connected to each other by means of a bridge 73 on which a sphere segment-shaped supporting element 75 is provided. Like the spring unit 27, the spring unit 27' can be manufactured as a single integral part from a metal sheet, the supporting element 75 in the bridge 73 being provided by means of, for example a stamping process. In the mounted state, the supporting element 75 rests on one of the supporting surfaces 77 which, viewed in a direction parallel to the cutting edges 7', are provided on a sliding member 79 so as to be stepped with respect to each other. The leaf springs 31', 33', 35', 37' each have an end portion 47' which supports the sub-frame 9' near, respectively, one of the four corners 49'. In a state where the shaving head 1' does not contact a skin surface to be treated, the sub-frame 9' bears against the above-mentioned stop 51' of the main frame 19' under the influence of an elastic pretension exerted by the leaf springs 31', 33', 35', 37' of the spring unit 27'. By means of two guiding elements 81, 83, the sliding member 79 is movably guided over two guiding elements 85 of the main frame 19' in a direction parallel to the cutting edges 7'; only one of said guiding elements 85 is shown in FIG 5. If the user moves the sliding member 79 with respect to the main frame 19', the supporting element 75 of the spring unit 27' comes to rest on a different supporting surface 77 of the sliding member 79, resulting in a change of the pretension exerted by the leaf springs 31', 33', 35', 37'. In this manner, the sliding member 79 with the supporting surfaces 77 forms said means for adjusting said pretension. Said means may be provided with customary means, which are known per se, for locking the supporting element 75 on any one of the supporting surfaces 77. As said pretension determines the contact force between the skin surface and the skin-supporting supporting members 11' and 13' of the sub-frame 9' as well as the skin curvature between the skin-supporting members 11' and 13', the user is capable of adjusting the pretension between the skin-supporting supporting members 11' and 13' of the sub-frame 9' by means of the sliding member 79 so as to obtain an optimum value or a personally preferred value. Since the spring unit 27' rests on the sliding member 79 by means of the sphere segment-shaped supporting element 75, the tilt freedom of the sub-frame 9' relative to the main frame 19' about the tilt axes 55 and 57, and hence the contour-following capacity of the shaving head 1', is increased substantially.

It is to be noted that the invention also includes embodiments wherein the sub-frame is coupled to the main frame in a different manner, i.e. not by means of the above-described spring unit 27, 27', and/or embodiments wherein the sub-frame can be displaced with respect to the main frame against a type of spring force other than the above-described pretension of the spring unit 27, 27'. An example of such an alternative embodiment is an embodiment wherein the spring force is a magnetic force of a system of permanent magnets which are secured on, respectively, the sub-frame and the main frame, the magnets of the sub-frame and the magnets of the main frame repelling each other. In this alternative embodiment, the sub-frame is displaceably guided with respect to the main frame by means of conventional guiding means.

It is further noted that the invention also includes embodiments wherein the main frame is not provided with a stop for the sub-frame, and wherein, in a state where the shaving head is not in contact with the skin surface, the mechanical spring unit is substantially free of pretension. In such an embodiment, the skin-supporting members of the sub-frame exert only a negligibly small contact force on the skin surface, so that a negligibly small skin curvature is formed between the skin-supporting members of the sub-frame.

It is further noted that the invention also includes embodiments wherein the shaving head cannot be detached from the handle and/or the shaving head comprises a different number of cutting blades, for example one or two.

What is claimed is:

1. A shaver comprising a shaving head including at least one cutting blade and four skin-supporting members, the cutting blade having a cutting edge extending perpendicularly to a shaving direction of the shaving head, and the skin-supporting members being arranged, viewed in the shaving direction, respectively, in front of and behind the cutting blade and having skin-supporting surfaces extending substantially in an imaginary skin contact surface, the shaving head also including a main frame and a sub-frame, with two of the skin-supporting members secured to the main frame, and the cutting blade and two of the skin-supporting members secured to the sub-frame, the sub-frame coupled to the main frame by at least one spring unit and displaceable against a spring force, with respect to the main frame.

2. A shaver as claimed in claim 1, wherein the spring force is directed towards the contact surface, and, in a state wherein the shaving head does not contact the skin surface, the sub-frame rests against a stop of the main frame under the influence of the spring force.

3. A shaver as claimed in claim 1, wherein the spring unit is at least tiltable with respect to the main frame about two mutually perpendicular tilt axes and displaceable with respect to the main frame in a displacement direction perpendicular to said tilt axes, thereby deforming the spring unit.

4. A shaver as claimed in claim 3, wherein the spring unit comprises a central portion and two pairs of leaf springs facing away from each other, which leaf springs each extend from the central portion in a direction substantially perpendicular to the shaving direction, and the sub-frame has a rectangular shape with four corners, and each leaf spring supports the sub-frame at a location close to a corner of the sub-frame.

5. A shaver as claimed in claim 1, wherein a skin-contacting member is provided on the main frame and/or on the sub-frame, which skin-contacting member contains a shaving aid.

* * * * *